US009103576B2

(12) United States Patent
Kuhn

(10) Patent No.: US 9,103,576 B2
(45) Date of Patent: Aug. 11, 2015

(54) ICE BUILDING MACHINE

(76) Inventor: Paul Kuhn, Anchorage, AK (US)

( * ) Notice: Subject to any disclaimer, the term of this patent is extended or adjusted under 35 U.S.C. 154(b) by 283 days.

(21) Appl. No.: 13/264,338

(22) PCT Filed: Apr. 14, 2010

(86) PCT No.: PCT/US2010/031053

§ 371 (c)(1),
(2), (4) Date: Mar. 2, 2012

(87) PCT Pub. No.: WO2010/120896

PCT Pub. Date: Oct. 21, 2010

(65) Prior Publication Data

US 2012/0153033 A1 Jun. 21, 2012

Related U.S. Application Data

(60) Provisional application No. 61/303,742, filed on Feb. 12, 2010, provisional application No. 61/244,890, filed on Sep. 23, 2009, provisional application No. 61/235,346, filed on Aug. 19, 2009, provisional application No. 61/169,060, filed on Apr. 14, 2009.

(51) Int. Cl.

| | |
|---|---|
| ***F25C 3/02*** | (2006.01) |
| ***F25C 1/00*** | (2006.01) |
| ***F25C 3/04*** | (2006.01) |
| *E02B 17/02* | (2006.01) |
| *F25C 3/00* | (2006.01) |

(52) U.S. Cl.
CPC ... *F25C 1/00* (2013.01); *F25C 3/04* (2013.01); *E02B 17/028* (2013.01); *F25C 3/00* (2013.01)

(58) Field of Classification Search
CPC ..... F25C 3/00; F25C 1/00; F25C 3/04; F25C 1/02; F25C 2303/048; E02B 17/028; E02B 1/00
USPC ..... 405/61, 195.1, 211, 217; 239/2.2, 14.2; 62/74, 75
See application file for complete search history.

(56) References Cited

U.S. PATENT DOCUMENTS

| | | | | |
|---|---|---|---|---|
| 4,063,428 | A | 12/1977 | Waas | |
| 4,523,879 | A | 6/1985 | Finucane et al. | |
| 4,567,731 | A * | 2/1986 | Horan | 62/59 |
| 4,699,545 | A * | 10/1987 | Chen et al. | 405/217 |
| 4,759,664 | A * | 7/1988 | Deal | 405/258.1 |
| 4,854,780 | A | 8/1989 | Hewlings | |
| 5,512,787 | A | 4/1996 | Dederick | |
| 6,813,557 | B2 * | 11/2004 | Schmidt et al. | 701/23 |
| 6,854,406 | B2 | 2/2005 | Cardoza et al. | |
| 7,578,642 | B2 * | 8/2009 | Fritsche et al. | 408/76 |
| 8,161,757 | B2 * | 4/2012 | Rosen | 62/74 |
| 2006/0018719 | A1 * | 1/2006 | Stern | 405/217 |
| 2007/0036618 | A1 | 2/2007 | Fritsche et al. | |

* cited by examiner

*Primary Examiner* — Benjamin Fiorello
*Assistant Examiner* — Carib Oquendo
(74) *Attorney, Agent, or Firm* — Lowe Hauptman & Ham, LLP

(57) ABSTRACT

An ice building machine for spraying a fluid comprising water to form ice is described. The machine comprises: a chassis; a power generating source connected with the chassis; a control module electrically connected with the power generating source; and a fluid spray system coupled with the chassis and arranged to spray a fluid under control of the control module and powered by the power generating source, the fluid spray system arranged to access the fluid from below a lower surface of the ice building machine.

19 Claims, 16 Drawing Sheets

FIG. 8B
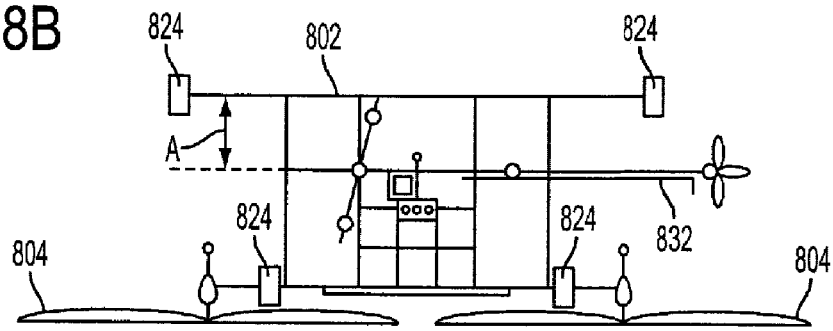
FIG. 8C
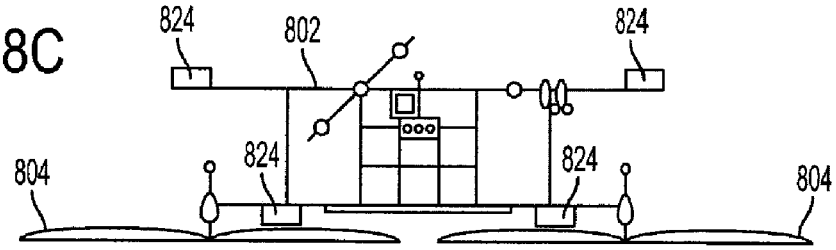
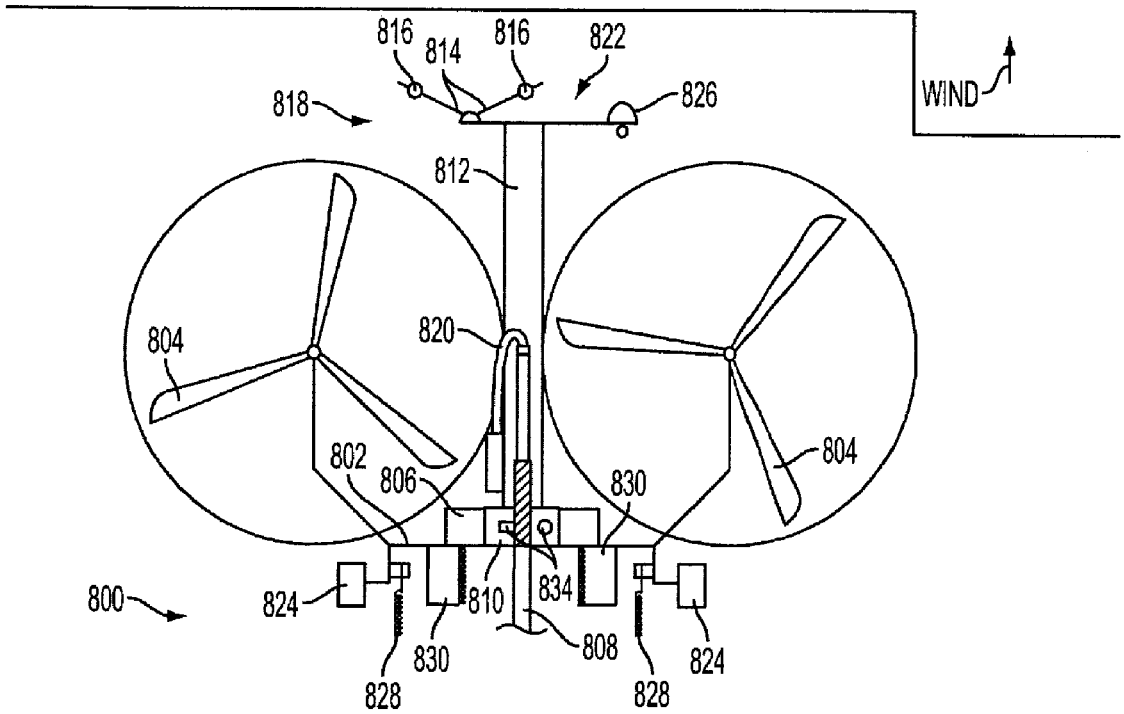
FIG. 8A

ICE BUILDING MACHINE

RELATED APPLICATIONS

The present application is a National Phase of International Application Number PCT/US2010/031053, filed Apr. 14, 2010, and claims priority from U.S. Provisional Application No. 61/303,742, filed Feb. 12, 2010; U.S. Provisional Application No. 61/244,890, filed Sep. 23, 2009; U.S. Provisional Application No. 61/235,346, filed Aug. 19, 2009; and U.S. Provisional Application No. 61/169,060, filed Apr. 14, 2009, the disclosures of which are hereby incorporated by reference herein in their entirety.

BACKGROUND

Ice construction vehicles of which the inventor is aware typically include a vehicle spreading water obtained from a truck or a stationary or semi-mobile pump combined with specialized nozzle setups for spraying water. Such systems are manned or require significant man-hour maintenance and support for setup and operation. The diffusion of water to form ice in below freezing temperatures is used for making snow, ice platforms, formations and massifs, roads and airstrips, as well as, off-shore industrial uses.

There are several ice-related problems including flooding during spring break-up of ice, loss of animal habitat as a result of ice free polar seas and loss of ice at the poles and its impact on the climate future. At latitudes having extended seasonal freezing, marine environments in response to rising spring temperatures cause billions of dollars in property damage as a result of spring thaw.

Sea ice increases the health and area range of wildlife. For example, seals raise, rest, and protect young on free flowing ice during the Arctic summer season. Polar bears also utilize sea ice to rest on while hunting.

Polar regions act as a heat sink or counter-weight to the heat regions of the globe, such as the tropics. Planetary differences in energy are a major influence driving atmospheric wind and ocean currents.

DESCRIPTION OF THE DRAWINGS

One or more embodiments are illustrated by way of example, and not by limitation, in the figures of the accompanying drawings, wherein elements having the same reference numeral designations represent like elements throughout and wherein:

FIGS. 8A-C are respective views of an ice building machine according to another embodiment;

DETAILED DESCRIPTION

Figure 1:
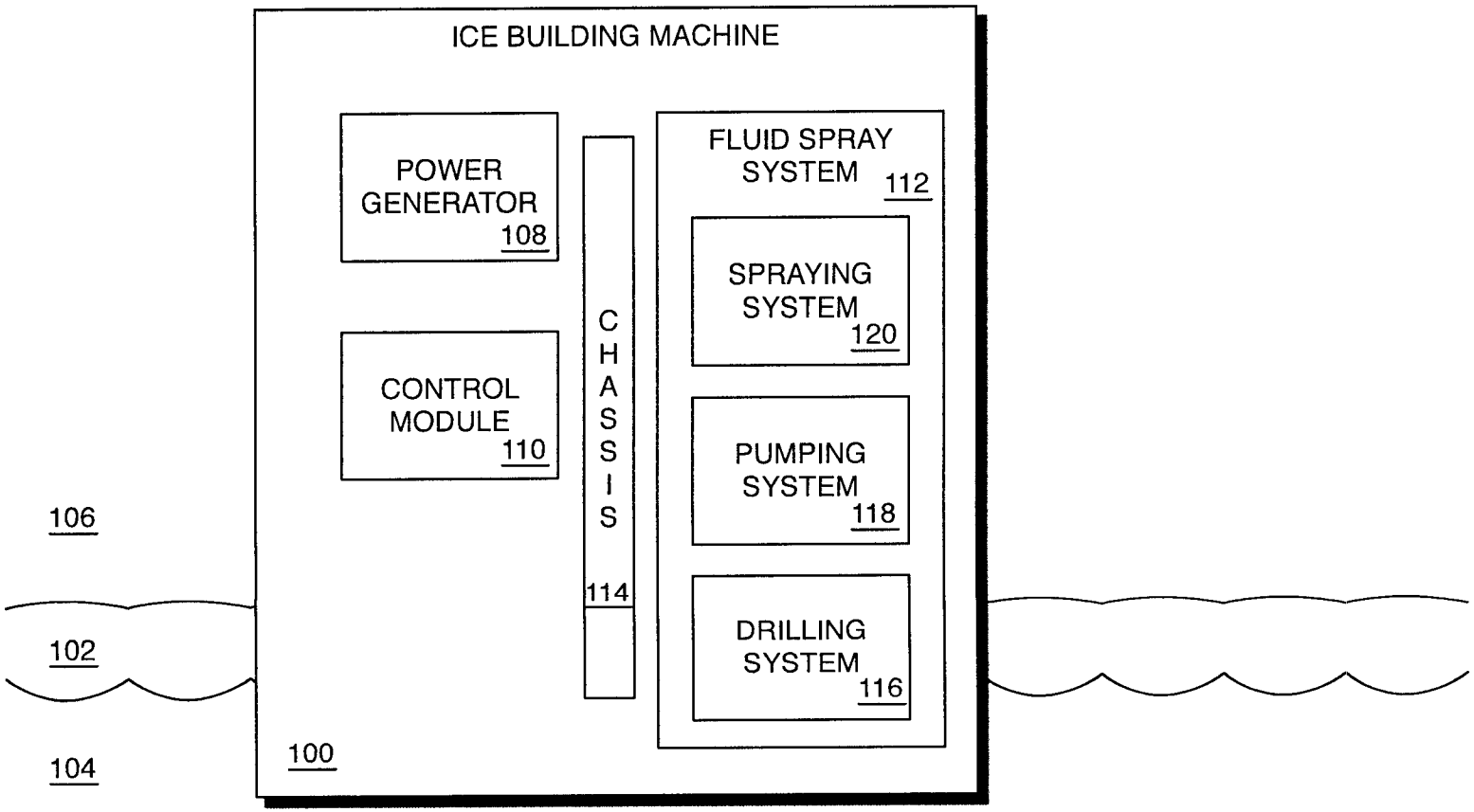
FIG. 1 is a high-level functional block diagram of an ice building machine (IBM) according to an embodiment.

FIG. 1 depicts a high-level functional schematic of an ice building machine (IBM) 100 according to an embodiment. In the depicted embodiment, at least a portion of IBM 100 extends below a surface of a sheet of ice 102 above a body of water 104. FIG. 1 is functional and not intended to depict the extent to which or which portions of IBM 100 extend below ice 102. Another portion of IBM 100 extends above ice 102 in ambient air 106. In at least some embodiments, IBM 100 is positioned solely on top of ice sheet 102 with only a drilling and pumping-related portion extending through the ice sheet and into water 104. In at least some embodiments, at least a portion of IBM 100 is positioned on top of at least a portion of a land mass. In at least some further embodiments, at least a portion of IBM 100 is positioned on top of a portion of a land mass and another portion of IBM 100 is positioned on top of ice 102.

In operation, IBM 100 pumps an amount of water 104 from below ice sheet 102 and sprays the water toward a surface of the ice or toward a portion of land in order to build one or more ice structures. IBM 100 sprays water 104 in accordance with a parametric combination of droplet size, distance, and volume in combination with an ambient air temperature such that the water sprayed loses sufficient heat during the spraying process that the water condenses to form ice prior to, during, or shortly after impact with a surface.

In accordance with at least one embodiment, IBM 100 comprises a power generator 108, a control module 110, a fluid spray system 112, and a chassis 114. In at least some embodiments, each of power generator 108, control module 110, and fluid spray system 112 are mounted on chassis 114. In at least some other embodiments, one or more of power generator 108, control module 110, and/or fluid spray system 112 are mounted, either directly or indirectly, to chassis 114.

Power generator 108 comprises one or more power generating systems. In at least some embodiments, power generator 108 is a fluid-based turbine driven hydraulic pump and/or electric generator. In at least some embodiments, power generator 108 comprises a wind turbine to convert rotational energy captured from wind flow into fluid compression stored in, for example, one or more accumulators and/or into electricity which may be stored in, for example, one or more batteries.

In at least some other embodiments, power generator 108 is an internal combustion or other fuel based engine generator.

Figure 2:
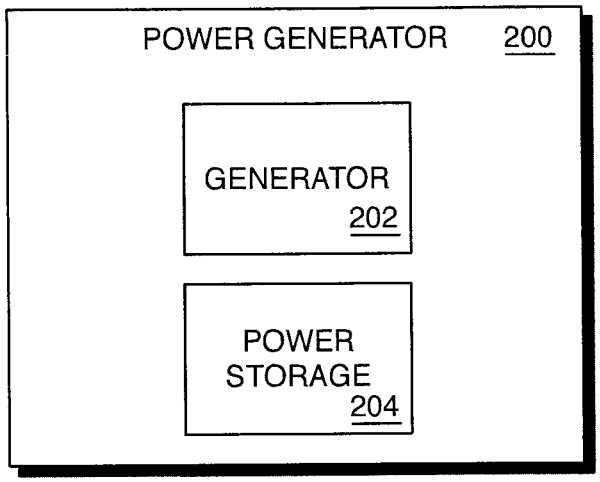
FIG. 2 is a high-level functional block diagram of a power generator according to an embodiment.

FIG. 2 depicts a high-level functional block diagram of a power generator 200 according to an embodiment. Power generator 200 comprises a generator 202 and a power storage 204 range to store power generated by the generator. As described above, generator 202 may comprise one or more of a wind turbine, an electric generator, a hydraulic pump, or a fuel-burning engine. In at least some embodiments, generator 202 is a marine current generator composed of a turbine blade for translating a fluid or current flow of water into a rotational force and by connection to a hydraulic pump or electric generator to thereby supply hydraulic pressure or electricity for operation of IBM 100. Power storage 204 may comprise one or more of a battery and/or an accumulator for storing compressed fluid.

Returning to FIG. 1, control module 110 comprises a processor and/or a controller-based system for controlling operation of IBM 100 according to one or more sets of stored instructions.

Figure 3:
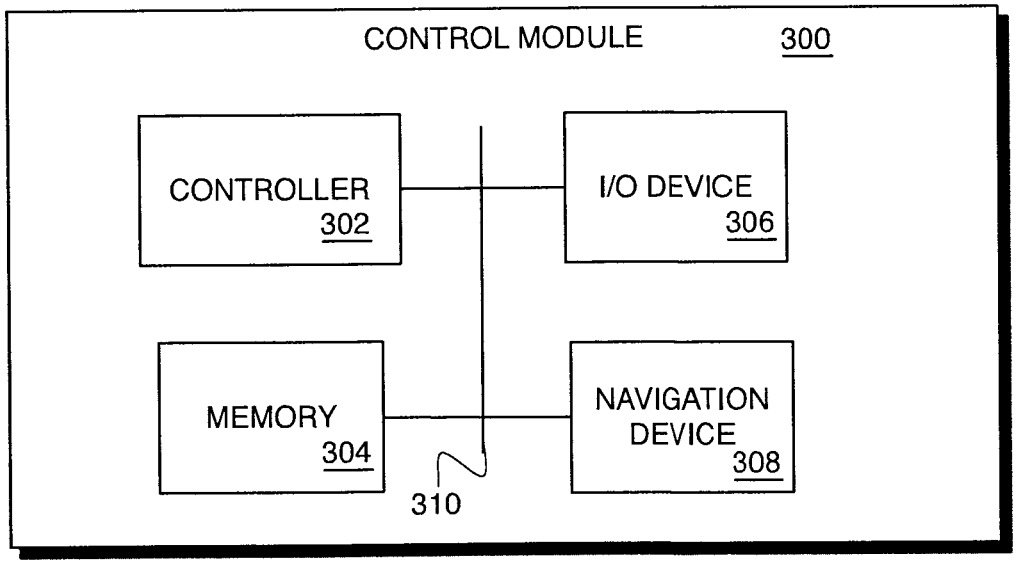
FIG. 3 is a high-level functional block diagram of a control module according to an embodiment.

FIG. 3 depicts a high-level functional block diagram of a control module 300 according to an embodiment which may be used as control module 110. Control module 300 comprises a controller 302 (or processor or processing device), a memory 304, an input/output (I/O) device 306, and a navigation device 308 each communicatively coupled with a bus 310. Memory 304 (also referred to as a computer-readable medium) is coupled to bus 310 for storing data and information, e.g., instructions to be executed by controller 302. Memory 304 also may be used for storing temporary variables or other intermediate information during execution of instructions to be executed by controller 302. Memory 304 may also comprise a read-only memory (ROM) or other static storage device coupled to bus 310 for storing static information and instructions for controller 302. Memory may comprise static and/or dynamic devices for storage, e.g., optical, magnetic, and/or electronic media and/or a combination thereof.

I/O device 306 comprises a mechanism for receiving information from one or more sensors connected to IBM 100, e.g., temperature, wind speed, humidity, pressure, range finding, video, sonar, thermal imaging, etc. I/O device 306 comprises a serial and or a parallel communication mechanism. Non-limiting, exemplary embodiments of I/O device 306 include at least a serial connection, a universal serial bus (USB) interface, an Ethernet interface, a WiFi or WiMAX or Bluetooth interface, a cellular interface, etc.

In at least some embodiments, I/O device 306 comprises a communication interface (communication module) through which IBM 100 transmits and/or receives commands and/or information from other devices or human operators. Further, in at least some embodiments, the communication interface is used to transmit reports regarding the condition of IBM 100 and/or the environment.

In at least some embodiments, I/O device 306 comprises a rescue module for generating a signal for transmission to aid in the recovery of lost or disabled/distressed machines. Because IBM 100 is, in some embodiments, arranged to sink as opposed to drift after submerging below the surface of ice 102, the location of the machine on the surface being constantly broadcast and recorded by remote and/or intermediate receiving stations, a last location of a lost and/or disabled/distressed machine is recorded.

Navigation device 308 comprises a receiver and/or a transmitter for communicating with a positioning system such as a global positioning system (GPS) to obtain and/or determine positioning information. In at least some embodiments, navigation device 308 is an optional component.

In at least some embodiments, navigation device 308 and/or I/O device 306 comprise a radar for generating a downward penetrating transmission for measuring snow, ice condition, density, thickness, etc. In at least some embodiments, a second radar or a portion of a single multiphase radar may be used to aid navigation and perform measurements in a horizontal direction. Information determined by the radar is supplied to controller 302.

Returning to FIG. 1, fluid spray system 112 comprises a mechanism for drilling through ice sheet 102 (in at least some embodiments), pumping water 104 from below the sheet, and spraying the water onto a surface to build ice structures. Fluid spray system 112 comprises a drilling system 116, a pumping system 118, and a spraying system 120 interconnected and fluidically coupled to access and transfer fluid from water 104 to be sprayed by the spraying system. In at least some embodiments, two or more components of fluid spray system 112 may be combined.

Figure 4:
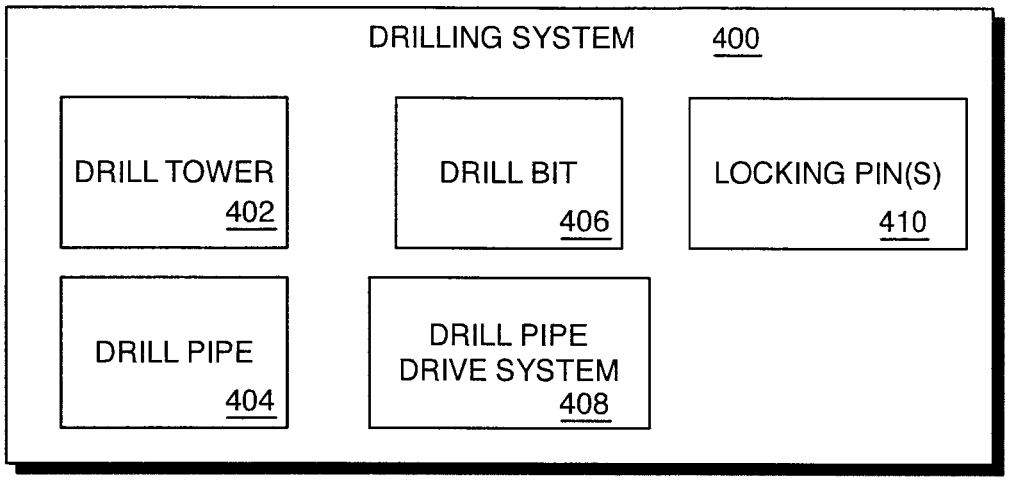
FIG. 4 is a high-level functional block diagram of a drilling system according to an embodiment.

FIG. 4 is a high-level functional block diagram of a drilling system 400 according to an embodiment which may be used as drilling system 116. In at least some embodiments, drilling system 400 comprises a drill tower 402 providing structural support for one or more of a drill pipe 404, one or more spray nozzles (of spraying system 120), a water pump (of pumping system 118), and/or other devices, electronics, or fluid connections for operation. In at least some embodiments, drill tower 402 is shaped similar to an exposed "I" beam and extends in a vertical direction. In at least some embodiments, the drill tower structure is aerodynamically covered and positioned on IBM 100 to minimize atmospheric turbulence imparted to the machine. Further, in some embodiments, the drill tower 402 structural mass is positioned to oppose the mass of turbines (for example in a wind powered system) to provide a counterbalance on chassis 114.

In at least some embodiments, drilling system 400 comprises a drill pipe 404 arranged to access and transport water 104 from below ice 102. In at least some embodiments, drill pipe 404 has a heated outer skin in order to prevent the pipe from freezing in place due to the pipe remaining within a drill hole in ice 102 for extended periods of time. In at least some embodiments, the outer surface of the drill pipe 404 is highly polished and/or smooth to minimize or hinder surface ice adhesion. Similarly, in some embodiments, drill pipe 404 is finished or coated with a non-stick substance or material, e.g., TEFLON to minimize or prevent ice adhesion.

In at least some embodiments, drilling system 400 comprises a drill bit 406 for drilling a throughhole in ice 102. In at least some embodiments, drill bit 406 is a coring type bit for efficient drilling of ice 102 to access water 104. In at least some embodiments, ice core drilled by drill bit 406 is ejected by the use of pneumatic force from a pneumatic pump.

In at least some embodiments, drilling system 400 comprises a drill pipe drive system 408 arranged to move drill pipe 404 vertically and rotationally. In at least some embodiments, drive system 408 is arranged to move drill pipe 404 only rotationally and a truck is positioned adjacent and connected with the drill pipe to move the drill pipe vertically. In at least some embodiments, drive system 408 applies vertical and or rotational force to drill pipe 404 by way of one or more drive wheels and/or belts and/or gearing mechanisms. In at least some embodiments, the force applied by drive system 408 is allowed to slip in order to accommodate pipe movement. For example, during a drilling operation a rotational forces applied to the drill pipe while allowing a particular amount of vertical slippage of the drill pipe during rotation. As such, the applied rotational force varies the physical contact between the drill pipe and drive system 408 in order to allow for vertical slippage downward during drilling.

In at least some embodiments, one or more vertically oriented drive wheels may be used to lower or raise drill pipe 404 to a desired depth or to align with one or more locking pins 410. In a similar manner, vertical and rotational drive mechanisms may be used to extract drill pipe 404 from a drilled hole in the ice 102.

In at least some embodiments, drilling system 400 comprises one or more locking pins 410 in order to physically connect to a pipe 404 to IBM 100, e.g., chassis 114 or a frame of the machine. In at least some embodiments, locking pins 410 may be used to apply leverage to attempt to extract drill pipe 404 in situations in which the drill pipe may be frozen in place. In this manner, additional force may be brought to bear on drill pipe 404 in conjunction with a suspension system of IBM 100 to remove the drill pipe. In at least some other embodiments, locking pins 410 are used to secure and retain drill pipe 404 in a retracted position away from ice 102. In at least some other embodiments, locking pins 410 are used to secure and retain drill pipe 404 in an operational position, to secure machine 100 in the event of high wind, and break frozen drill pipe loose from a hole.

Figure 5:
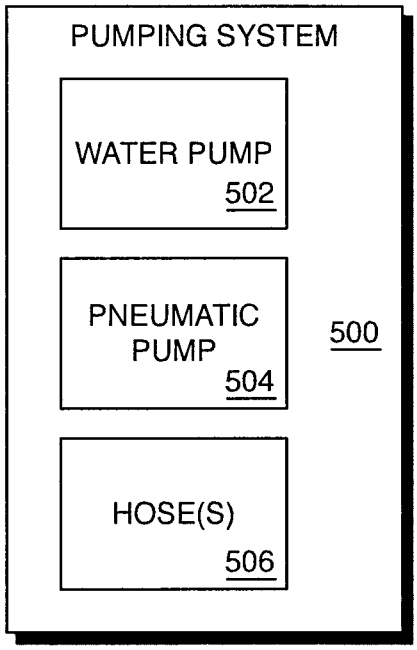
FIG. 5 is a high-level functional block diagram of a pumping system according to an embodiment.

FIG. 5 is a high-level functional block diagram of a pumping system 500 according to an embodiment which may be used as pumping system 118. Pumping system 500 comprises a water pump 502, a pneumatic pump 504, and one or more hoses 506 for connecting fluid between pumping system 118 and drilling system 116 and/or spraying system 120. In at least some embodiments, water pump 502 is connected with drilling system 116 and spraying system 120 in order to pump water 104 from the drilling system to the spraying system. In particular, water pump 502 transfers water from drill pipe 404 to spray heads of the spraying system. In at least some embodiments, pumping system 500 comprises an alternate water intake in order to supply water to water pump without the use of drill pipe 404, e.g., for use when IBM 100 is positioned on the land. In such a scenario, the alternate water intake may be mounted on and/or within and extendable or fixed boom arm.

In at least some embodiments, water pump 502 comprises a self priming pump capable of at least 5 feet of lifting capacity above water line. In at least some embodiments, a second electric pump may be used to to increase the load capability of IBM 100 beyond that provided by a hydraulically powered water pump.

Pneumatic pump 504 is arranged to provide services such as ejecting ice cores from drill pipe 404 and priming or clearing water from spray nozzles and supply lines.

One or more hoses 506 provide fluid flow connections between drill pipe 404 and water pump 502 and/or an alternate intake to the water pump.

Figure 6:
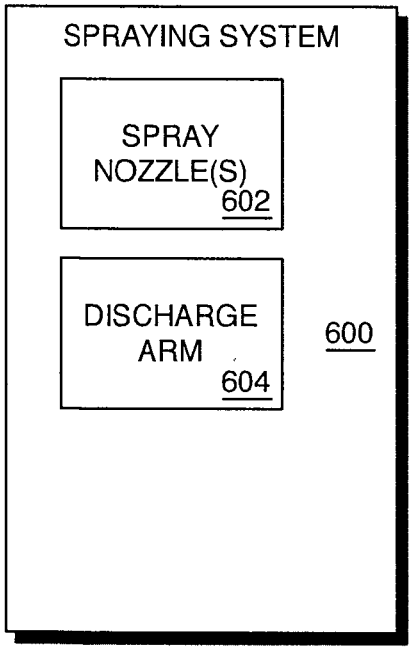
FIG. 6 is a high-level functional block diagram of a spraying system according to an embodiment.

FIG. 6 is a high-level functional block diagram of a spraying system 600 according to an embodiment which may be used as spraying system 120. Spraying system 600 comprises one or more spray nozzles 602 and, in at least some embodiments, an optional discharge arm 604. Spray nozzle 602 includes one or more variable parameters such as direction, aeration, and flow rates. In at least some embodiments, nozzle modes and types include one or more of providing aeration in a water stream sprayed for reflectivity, having high flow rates for flood and freeze impounding, varying the water droplet size within a spray stream, minimizing mixing with environmental gas for stronger finished ice structures, and/or being able to operate with solid matter within the water pumped for spraying sedimentary insulation for particular layers, e.g., a top or finish layer on an ice structure. As described above, one or more spray nozzles 602 is connected with pumping system 500, e.g., water pump 502, via one or more hoses 506.

In at least some embodiments, spraying system 600 comprises discharge arm 604 to extend the spraying range of spray nozzle 602 which may be affixed toward an end of the arm. In at least some embodiments, one or more spray nozzles 602 are mounted on a rotatable spray head of arm 604 and controlled via rapid opening and closing of a flow valve to provide accurate throw and placement of a sprayed water stream to a surface.

Returning to FIG. 1, IBM comprises a chassis 114 to which one or more of power generator 108, control module 110, fluid spray system 112 and other devices are affixed. In at least some embodiments, chassis 114 includes a slide-out portion which extends the size of the chassis for stability.

In at least some embodiments, chassis 114 comprises a suspension, e.g., hydraulic based, for raising and lowering the chassis in order to aid in navigation, leveling IBM 100, and other operations.

In at least some embodiments, all or a portion of IBM 100 may be covered by one or more enclosures to provide one or more of aerodynamics, insulation, heating, and/or ventilation. In at least some embodiments, the enclosure is arranged such that a strong reflection of sonar and/or radar signals may be provided in order to aid in recovering IBM 100, e.g., if the machine were to sink below the surface of the water.

In at least some embodiments, IBM 100 floats, either anchored to the bottom of water 104 or freely floating, as a buoy arranged to spray water pumped from under ice 102 to a surface to build ice structures.

Figure 7:
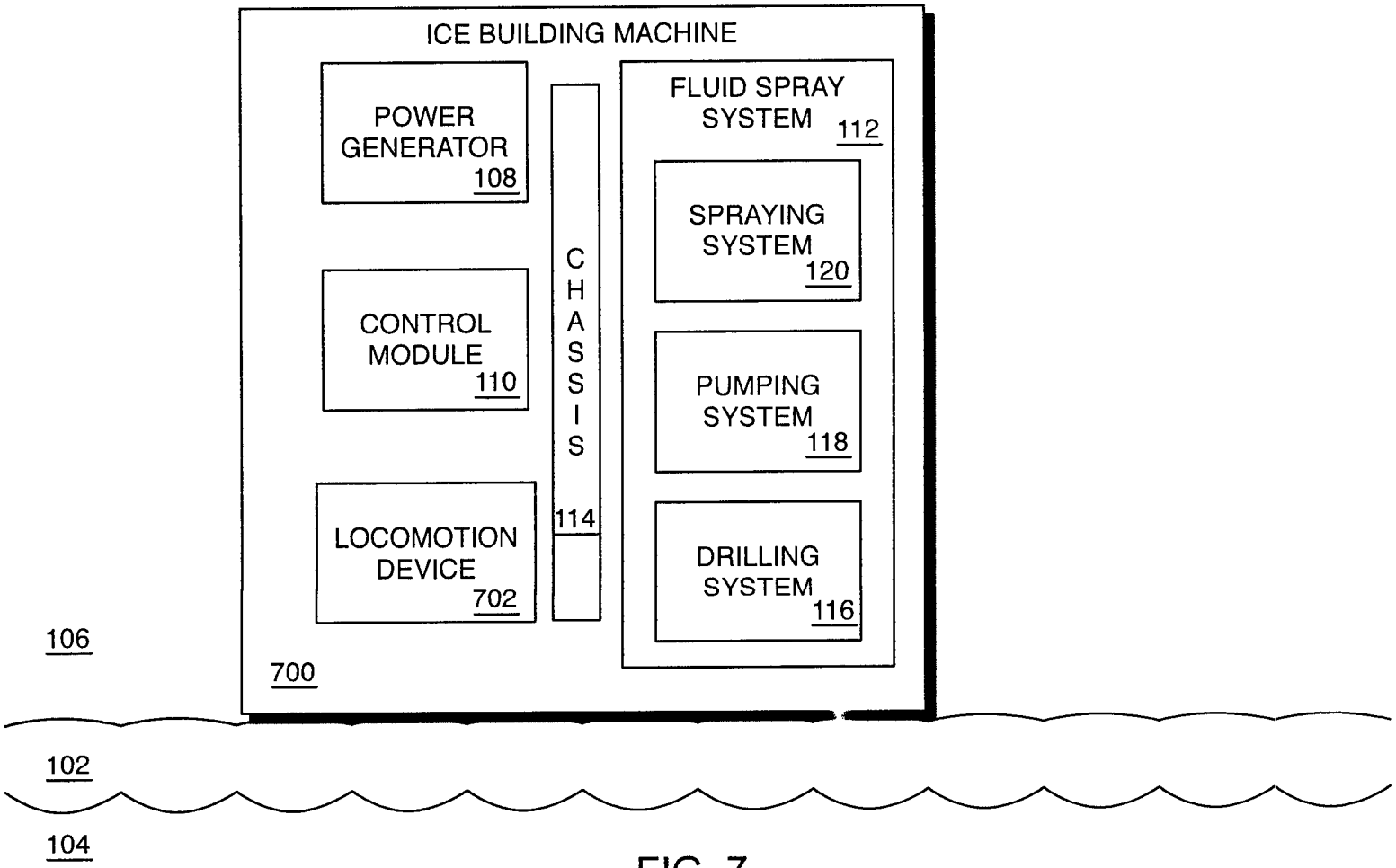
FIG. 7 is a high-level functional block diagram of an ice building machine according to another embodiment.

FIG. 7 is a high-level functional block diagram of an IBM 700 which is a variation on the FIG. 1 embodiment. In accordance with the FIG. 7 embodiment, IBM 700 is positioned atop a surface of ice 102. In accordance with the particular scenario, drilling system 116 extends through ice 102 into water 104.

IBM 700 additionally comprises a locomotion device 702 to move the machine from location to location or along a predetermined path. In at least some embodiments, locomotion device 702 is a set of wheels in combination with an engine, e.g., wind-powered, pneumatic-powered, combustion powered, etc. In at least some embodiments, IBM 700 comprises a set of 3, 4, or more wheels. In at least some embodiments, all wheels are driven by the engine thereby providing all wheel drive to IBM 700.

In at least some embodiments, all wheels of locomotion device 702 are 360° directionally steerable. In at least some embodiments, wheels having the ability to steer and drive IBM 700, while on station and building ice structures, is helpful to keep turbines directed into a wind flow in order to free drill pipe 404 by the use of rotational force of IBM 700, in particular chassis 114.

In at least some embodiments, an operator creates a desired path for IBM 700 with respect to a location for a particular ice structure positioned on a map using a computer system. The desired or predetermined path is then transferred to IBM 700 and stored in control module 110 to determine commands provided to locomotion device 702 as the machine operates.

In at least some embodiments, the predetermined path is specified through the use of machine recognizable survey stakes which are placed along the path in a work area. In at least some embodiments the machine recognizable survey stakes are used to specify areas or features to be avoided or where additional spray time is needed and/or where different spray parameters may be used.

In at least some embodiments, the machine recognizable survey stakes comprise radio frequency identifiers embedded within the states which are readable by and/or responsive to a signal from IBM 700 to transmit information to the machine. For example, the information may identify spray/don't spray areas, areas in which operator assistance may be needed, nesting areas to be avoided, new structures not included on a map, or hazards such as overhead cables or underwater pipelines.

Operational Description

In at least some embodiments, IBM 100 is outfitted and sized according to the type of work and conditions expected. For example, a machine 100 working on sea ice obtains power from the wind and carries a longer drill pipe and ice screws. For local work, replacing or aiding the wind turbine, an additional internal combustion engine (ICE) is added to provide power for machine 100 to work.

Nozzles types and sizes also vary, depending on the work and weather conditions expected. in some embodiments, nozzles comprise variable direction of spray (up, down and sideways) and various types of nozzles are fitted for expected flow rates and sizing of particles dispersed. More sophisticated nozzles are useable which have machine controlled adjustments for flow rate, particle dispersion size, direction of spray, etc.

Similarly, if the remote area of operation is found to have steady and constant wind events with little wind speed variation (undesirable gusting), then a purely wind powered machine uses hydraulics as the primary working fluid with electricity generation being a secondary form of energy for powering the machine's electric devices. In at least some embodiments, machine 100 uses electric and hydraulic force in operation. Because of cost, reliability, packaging and other considerations, using hydraulics for mobility, drilling and pumping/spraying (the biggest energy uses) increases overall efficiency.

Upon receiving instructions (software instructions) at the machine location or from a remote operator, machine 100 fully charges an on-board battery and accumulates working fluid in, e.g., an accumulator derived from the drill pipe or an alternate water intake.

Typically, as the seasonal temperature averages move below freezing, machine 100 accumulates energy for work, to first move to a given location on or near the frozen surface of a marine body. As machine 100 travels to predetermined GPS coordinates, on board sensors, e.g., navigation devices, aid in navigation. In at least some embodiments, additional sensors detect anomalies in the ice and atmosphere. Anomalies are those environmental features not normally present in a predetermined static environment. Translated into digital code from energy transmission and detection equipment, recording "hits", anomalies include mammals, machines, open water, thin ice, pressure ridges, biomass, geologic shapes, etc.

As programmed, machine 100 responds to anomalies in a predetermined manner and reports higher status anomalies wirelessly to other machines and/or to a remote human controller via a wireless network connection. Example anomalies include open water at sea, called, "leads". When a lead is detected by a traveling IBM 100, the machine stops and reports the condition.

Without human intervention, machine 100 determines if the lead is "bridgeable", i.e., where the machine builds an ice bridge for crossing the lead, or if it is better to go around the area of open water by straying off of a direct path to the predetermined coordinates. By networking, machine 100 is able to determine the movement of ice in relation to a given location. By "knowing" the predicted winds, wind speeds and ice sheet drift, etc., at the actual location of other machines 100, a given machine is able to avoid 'anomalies' and/or cross over and/or avoid objects in order to travel in an efficient manner.

When not able to travel over an obstacle, such as moving edges of a lead or a lead which is too wide, or when pressure ridges are too tall or growing, machine 100 moves parallel to the anomaly until a crossing is found. After altering a planned course, machine 100 self corrects to the predetermined destination or receives alternate instructions from remote command.

Basic command instructions include stopping diffusion and transit operations within a given distance of mammals, recognizable markers, and other machines 100. Avoidance maneuvering around anomalies and reporting for human intervention when and before machines or objects become endangered.

With downward looking radar or other detection equipment, machine 100 determines if a particular path of travel upon the ice is of a density and thickness sufficient to support travel of the machine. In the presence of deep snow (of a predetermined density and depth) and with access to water, machine builds an ice surface ahead of its direction of travel by icing or hardening a proposed travel surface. Machine 100 determines when to autonomously access and diffuse water upon a surface to aid in traveling over deep snow, leads or pressure ridges, etc. Machine 100 makes use of ice structures built for transportation by other machines.

On station, machine 100 drills a hole in the ice by rotating the drill tower with a drill or coring bit to be able to drill through an ice sheet to obtain water. Having made a whole at the desired location, machine ejects ice core with pneumatic force supplied by pneumatic pump, then pumps and sprays water upon or near body of water in a manner desired and within weather conditional parameters.

If a wall of ice is desired, machine 100 travels along predetermined frozen marine shores and waterways, which have hanging nearby material (likely fabric) supported by one or more masts along the desired path of the wall. Hanging material is to arrest and guide the sprayed water, thereby forming a vertical accumulation of ice. Repeated spraying during sub freezing temperatures results in a wall of ice, in a location desired and, if sized appropriately, able to withstand spring flooding.

Where a lake or the sea surface freezes, machine 100 drills a hole to pump water, for making artificial ice bergs or ice structures such as roads, air strips, industrial platforms and massifs grounded near shore on an open polar sea.

Instead of a precise location of sprayed water forming an ice wall, machine 100 pumps as much water onto the surface as possible to build less precisely laid structures. Low temperature and high wind allow a more solid stream of water to be pumped in a flood freeze manner—versus a finer spray needed with higher freezing temperatures and no wind—in order to have similar freeze rates of accumulating water/ice.

In making ice patties, e.g., regions of a surface such as land, water, or other existing snow/ice, machine 100 diffuses spray with the aid of the wind only far enough from the machine to keep the machine from freezing in place from accretion and or runoff. Water may also be sprayed in such a manner as to form frozen shapes upon the ice.

Figure 27:
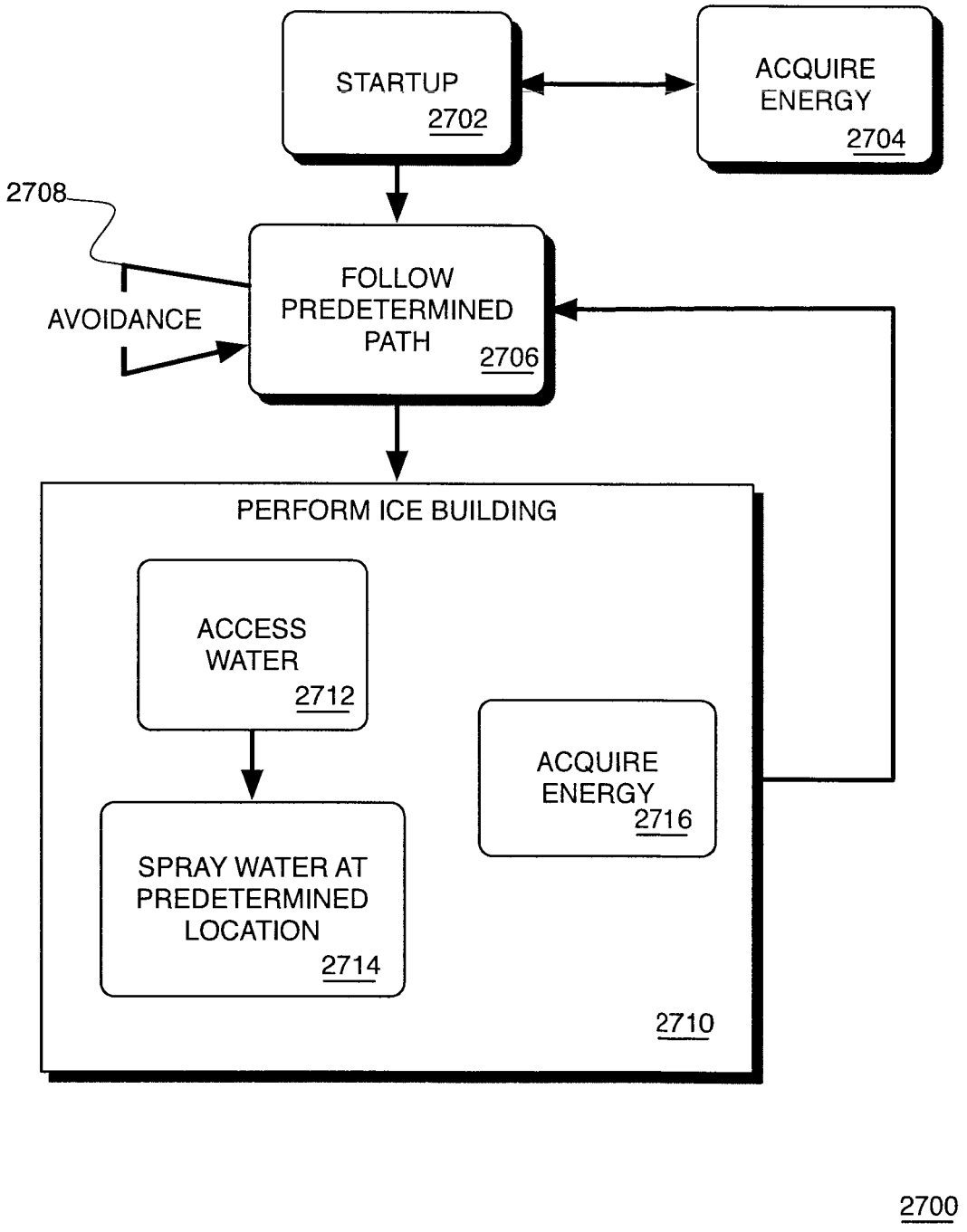
FIG. 27 is a high-level functional process flow of operation of an IBM according to an embodiment.

FIG. 27 is a high-level functional block diagram of a flow chart of an operational process flow 2700 of operation of IBM 700 according to an embodiment. The process flow begins at startup functionality 2702 wherein control module 110 begins execution of a set of instructions stored in memory, e.g., a computer-readable medium. In at least some embodiments, the set of instructions is received via a wired and/or wireless connection to a remote or separate computer system and stored in memory. In at least some embodiments, control module 110 also receives a predetermined path along which the machine 700 is to follow and spray water at locations to build ice structures. In at least some embodiments, the predetermined path comprises a single location whereas in other embodiments, the predetermined path comprises multiple locations, dwell times, spray parameters, and other parameters. In at least some embodiments, some of the other parameters include a minimum temperature at which to begin spraying, a minimum time period or a limited time range during which to spray, a set of parameters related to obstacles to be avoided, etc. Depending on time/day considerations and/or environmental factors, e.g., whether the temperature is sufficient to build ice structures, the process flow proceeds to either functionality 2704 or move functionality 2706.

If the weather is not acceptable, i.e., below a predetermined threshold value for ice building, and machine 700 does not have sufficient stored energy to move to a first spraying location, the process flow proceeds to functionality 2704 and the machine proceeds to acquire sufficient energy to move to the first spraying location. In at least some embodiments, machine 700 comprises another energy source such as a combustion or other energy source which can provide energy for moving the machine and the flow proceeds to functionality 2706 without acquiring energy in functionality 2704. After acquiring sufficient energy, the process flow proceeds to return to startup functionality 2702 and then to move functionality 2706.

During execution of movement functionality 2706, machine 700 responsive to inputs comprising at least navigation information from navigation device 308 (FIG. 3) moves along the predetermined path to a first spraying location. In at least some embodiments, machine 700 is a buoy and need not have or execute move functionality 2706.

If during execution of move functionality 2706, machine 2700 detects an obstacle, e.g., an animal, a lead, etc., the machine performs an avoidance maneuver 2708. For example, machine 700 may detour around or proceed to build an ice bridge across an obstacle.

In at least some embodiments, machine 700 stops along predetermined path if needed to acquire additional energy.

After arriving at the first spraying location, the process flow proceeds to perform ice building functionality 2710. During execution of functionality 2710, machine 700 uses drilling system 116 (FIG. 1) to access water below the surface and spraying system 120 in combination with pumping system 118 to pump and spray accessed water toward a desired surface. In at least some embodiments, machine 700 uses an alternate water intake to access water without requiring drilling.

Execution of access water functionality 2712 causes machine 700 to operate drilling system 116 to drill with drill pipe 404 through an ice sheet 102 to access water. After accessing water or drilling to a predetermined depth, the process flow proceeds to spray functionality 2714.

Execution of spray functionality 2714 causes machine 700 to operate pumping system 118 to pump accessed water to spraying system 120 and to operate the spraying system to spray the water toward the predetermined surface.

During execution of ice building functionality 2710, e.g., concurrent with, intermittently during, or prior to or after completion of functionality 2712 and 2714, machine 700 (in at least some embodiments) executes acquire energy functionality 2716 similar to functionality 2704.

After completion of ice building functionality 2710 at the first spraying location, if additional spraying locations have been specified the flow proceeds to move functionality 2706 to move to the next spraying location. In at least some embodiments, the flow proceeds to perform acquire energy functionality 2716 until the next spraying opportunity or specified time.

FIGS. 8A-C are front and top views of an ice building machine 800 according to a wind-based mobile embodiment. As depicted in front view in FIG. 8A, IBM 100 comprises a chassis 802 on which are mounted two wind turbines 804 (corresponding to power generator 108 of FIG. 1), a control module 806 (corresponding to control module 110 of FIG. 1), and a drill pipe 808, a drill pipe drive system 810, a drill tower 812, a discharge arm 814, and a pair of spray nozzles 816 comprising at least a portion of a fluid spray system 818 (corresponding to elements of fluid spray system 112 of FIG. 1). IBM 800 also includes a hose 820 connecting drill pipe 808 to a spraying system 822 (corresponding to spraying system 600 of FIG. 6 and comprising discharge arm 814 and spray nozzles 816 mounted thereon).

In at least some embodiments, IBM 800 comprises greater or fewer number of wind turbines 804 depending on environmental and power generating/consuming factors. In at least some embodiments, control module 806 operates to keep turbines 804 facing 'into' the wind using multi direction all wheel drive of wheels 824 (corresponding to locomotion device 702 of FIG. 7).

IBM 800 also comprises one or more navigation components 826 (corresponding to navigation device 308 of FIG. 3) affixed atop drill tower 812. In at least some embodiments, navigation components 826 comprises one or more of a GPS device, a radar device, or other navigation devices.

IBM 800 further comprises one or more ice screws 828 connected to chassis 802 and arranged to be driven/screwed into an ice sheet to provide further stabilization of the machine. In at least some embodiments, ice screws 828 are automatically affixed to the ice sheet. IBM 800 further comprises optional flaps 830 arranged to aerodynamically create a downforce on the machine as a result of interaction with wind. In at least some embodiments, flaps 830 are etched, cut, and/or formed to provide a secondary function of reflecting acoustic sonar or other atmospheric or generated electromagnetic signal in order to aid in locating lost machines.

Drive wheels 834 form a part of drill pipe drive system 810 and are arranged to work, i.e., rotate to attempt to break free, drill pipe 808. In at least some embodiments, drive wheels 834 rotate drill pipe 808 clockwise/counter-clockwise in conjunction with insertion of locking pins 1504 into receptacles 1502 fixing the pipe with respect to the chassis.

FIG. 8B is a top view of the FIG. 8A embodiment having a boom arm 832 extended, i.e., deployed, and chassis 802 in an extended position to enhance stability. Chassis 802, as depicted, is extended by an amount A away from the front of IBM 100. The extension of chassis 802 is performed by one or more of sliding, pulling, pushing, ratcheting or otherwise moving a rear portion of the chassis away from the front portion. Drill tower 812 offers operational structural support for various components, in some embodiments being placed at the back center of the chassis 802. In at least some embodiments, drill tower 812 provides additional center of gravity balance and is placed to minimize aerodynamic flow disruption.

FIG. 8C depicts chassis 802 in a non-extended position.

In at least some embodiments, greater or fewer numbers of components of IBM 800 are useable. For example, greater or fewer number of wheels 824 may be used in some embodiments. In at least some embodiments, IBM 800 comprises only three wheels 824 whereas in other embodiments more than four wheels 824 may be used.

Figure 9:
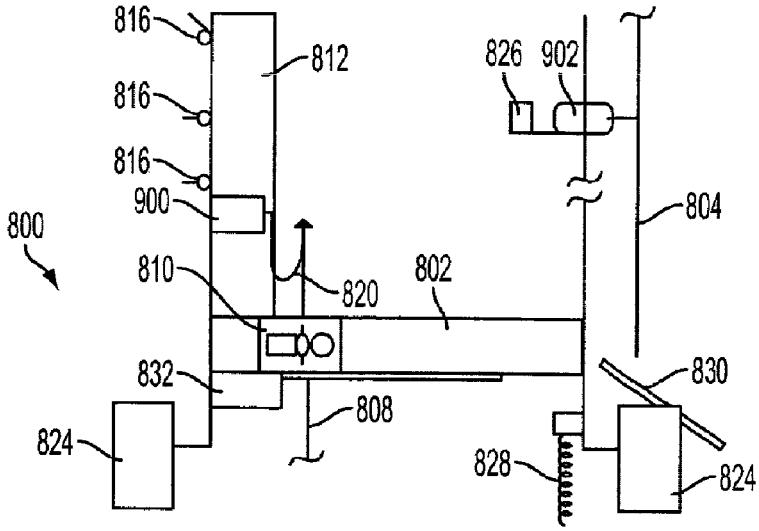
FIG. 9 is a side view of an ice building machine in a non-extended position according to an embodiment.

FIG. 9 is a side (starboard or right side) view of IBM 800 in a non-extended position. As depicted on the starboard side, chassis 802 is compact, i.e., in a non-extended position, wheels 824 are set for side to side machine movement as in FIG. 8C, ice screw 828 and aerodynamic flap 830 are deployed. Extendable boom 832 is retracted and stored in chassis 802. In at least some embodiments, boom 832 placement and deployment angle are altered with design placement consideration.

IBM 800 further comprises a water pump 900 (corresponding to water pump 502 of FIG. 5) and arranged to pump water from hose 820 to spray nozzles 816. IBM 800 further comprises an electric generator and hydraulic pump 902 connected with wind turbine 804 which operates responsive to wind turbine 804 rotation. In at least some embodiments, generator and pump 902 comprises one or more gearing mechanisms prior to connection with wind turbine 804.

Figure 10:
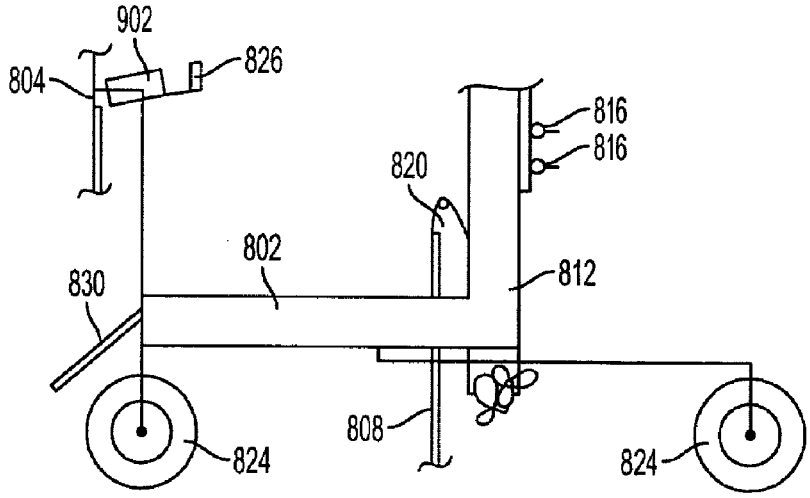
FIG. 10 is another side view of an ice building machine in an extended position according to an embodiment.

FIG. 10 is a side (port or left side) side view of IBM 800 in an extended position. As depicted, a portion of chassis 802 is extended away from the front of the chassis, wheels 824 are set for front to back movement of the machine, and flaps 830 are deployed. Extendable boom 832 is stowed.

Figure 11:
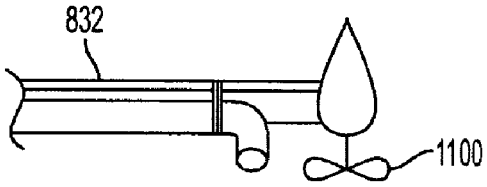
FIG. 11 is a detailed view of an end of an extendable boom according to an embodiment.

FIG. 11 is a detailed view of an end of extendable boom 832 with water contact components. A fluid (water) based turbine 1100 is shown smaller than actual size. Turbine 1100 turns fluid current (water stream) into rotational force for working fluid compression or electric generation.

Figure 12:
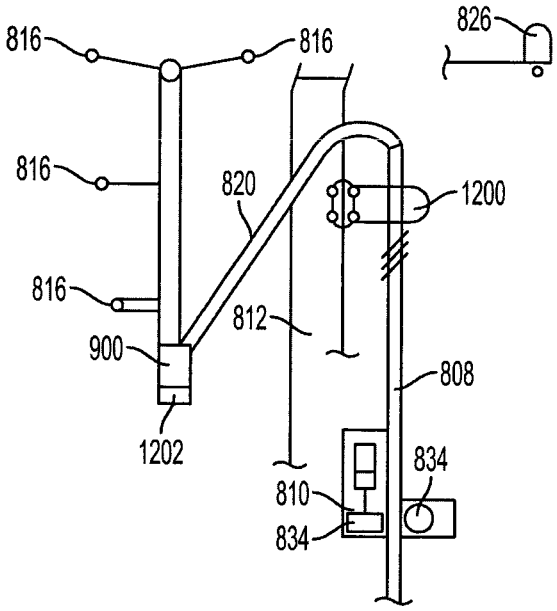
FIG. 12 is a side detail view of a drill pipe drive system according to an embodiment.

FIG. 12 is a side detail view of drill pipe drive system 810 for working drill pipe 808, ice screw threads 828, an upper drill pipe truck 1200 with wheels guided (and supported) by drill tower 812. Truck 1200 is used to raise and/or lower drill pipe 808. In at least some embodiments, truck 1200 is not motorized and only operates to guide an upper portion of pipe 808 in conjunction with drive system 810. IBM 800 also comprises a pneumatic pump 1202 (corresponding to pneumatic pump 504 of FIG. 5).

Figure 13:
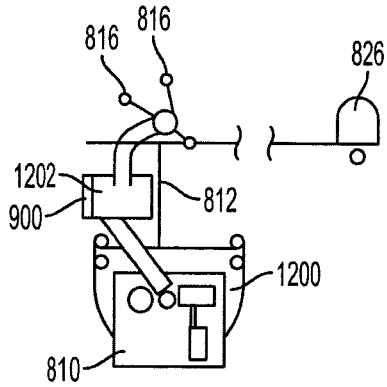
FIG. 13 is a top view of an IBM according to an embodiment.

FIG. 13 is a top view of the FIG. 12 IBM 800 embodiment comprising components placed around and using drill tower 812 as structural support. In particular, truck 1200, drill pipe drive system 810, pneumatic pump 1202, water pump 900, spray nozzles 816, and navigation components 826 are connected to drill tower 812.

Figure 14:
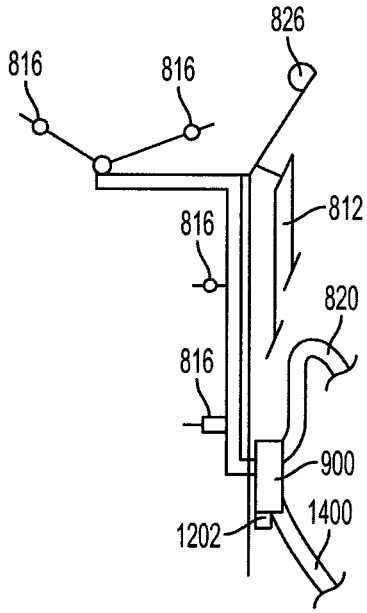
FIG. 14 is a side detail view of a portion of an IBM according to an embodiment.

FIG. 14 is a side detail view of water pump 900, pneumatic pump 1202, input hoses 820, 1400 (from an alternate, optional water intake, e.g., through use of extendable boom 832), nozzles 816 and 'yard arms' (not labeled). Electronic sensors, e.g., navigation components 826, and spray nozzles 816 are placed at or near the top of the drill tower 812, with marine industry standard 'yard arms' used to accommodate one or more components and/or devices.

Figure 15:
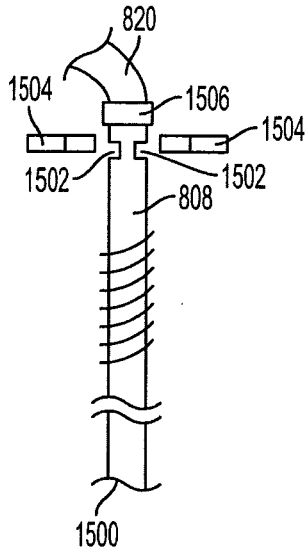
FIG. 15 is a side detail view of another portion of an IBM according to an embodiment.

FIG. 15 is a side detail view of drill pipe 808 according to an embodiment. As depicted, drill pipe 808 comprises a drill bit 1500 (corresponding to drill bit 406 of FIG. 4) at one end of the drill pipe and a pair of locking pin receptacles 1502 on opposing sides of the drill pipe. The locking pin receptacles 1502 receive a corresponding pair of locking pins 1504 to lock drill pipe 808 in position and not allow rotation or vertical movement of the drill pipe. In at least some embodiments, locking pins 1504 in conjunction with locking pin receptacles 1502 are used to extract a frozen drill pipe 808 from a drilled hole. Drill pipe 808 also comprises a seal 1506 at the connection of drill pipe 808 and hose 820 (which in at least some embodiments enables rotation between the drill pipe and the hose). Not shown is the length of pipe extending between locking pin receptacles 1502 and seal 1506, said section of pipe is structurally secured and carried or supported by truck 1200.

Figure 16:
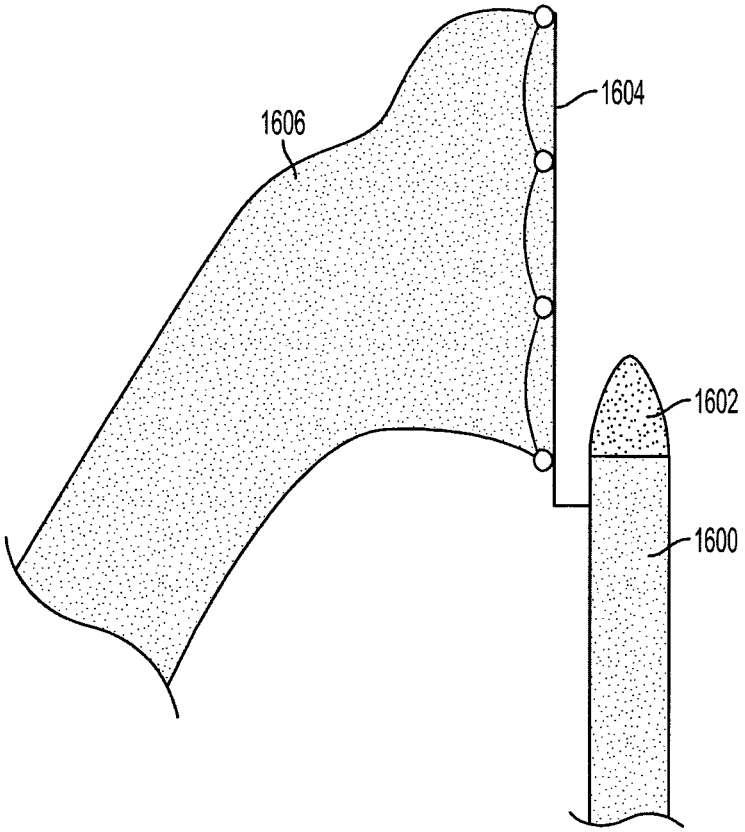
FIG. 16 is a view of a piling according to an embodiment.

FIG. 16 is a view of a piling 1600, tipped for use under water with a melter 1602. A mast 1604 holds ice guiding/forming material 1606. Mast 1604 and material 1606 are components used for guiding the building and securing of ice structures.

Figure 17A:
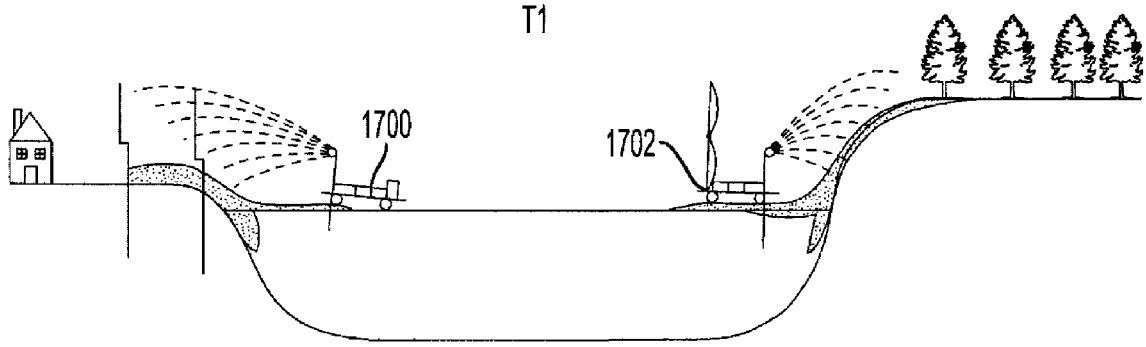
FIGS. 17A-b are cutaway views of a marine waterway having an IBM according to an embodiment.
Figure 17B:
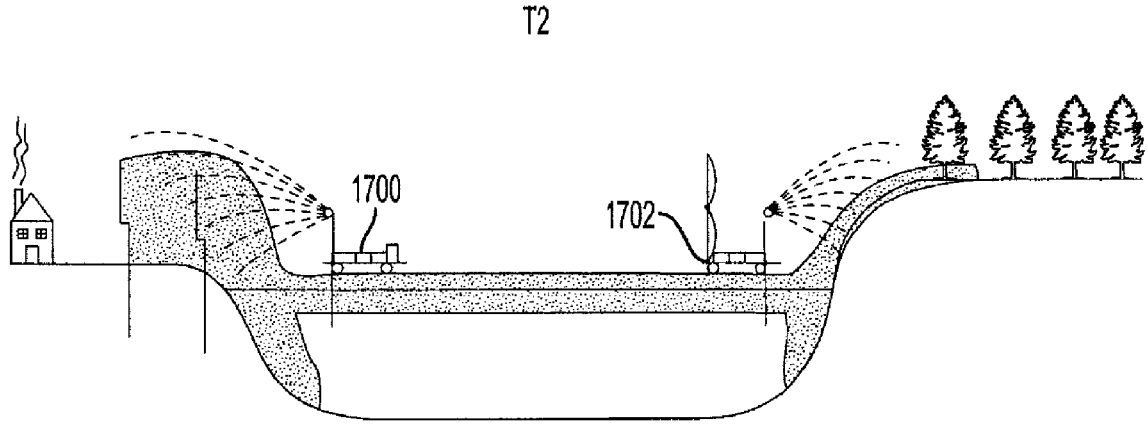

FIGS. 17A and 17B are cutaway views of a marine waterway at sequential time periods. The passage of time between T1 (FIG. 17A) and T2 (FIG. 17B) represents the buildup of ice over time. IBM 1700 is a fuel powered vehicle and a second IBM 1702 is powered by the wind. IBM 1700 is building a protective ice wall while IBM 1702 is impounding highland water and or building ice on a surface for erosion protection. Each of machines 1700, 1702 work autonomously when weather permits.

Figure 18:
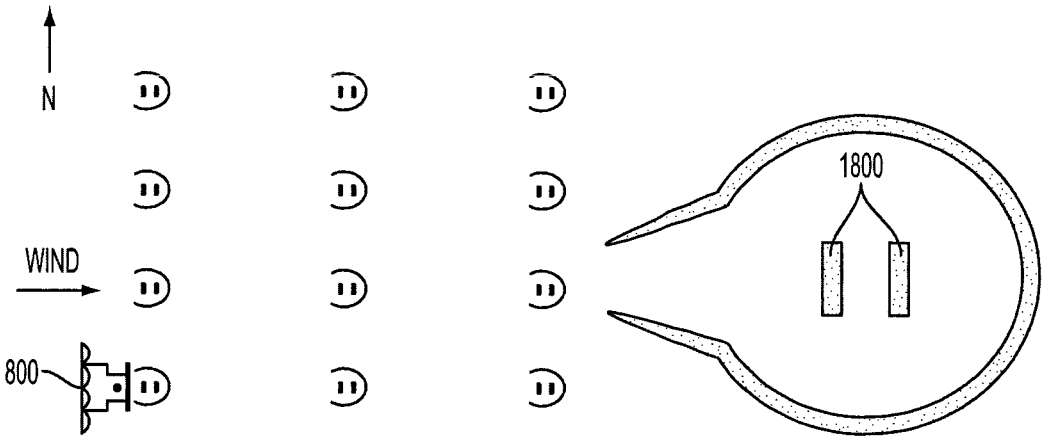
FIG. 18 is a view of an example of a shape used on a polar sea according to an embodiment.

FIG. 18 is a view of an example of a shape used on a polar sea in accordance with at least some embodiments. IBM 800 would be used to make semicircle ice walls open toward the prevailing winds in order to facilitate the accumulation of surface blown snow within said circular wall of ice. This arrangement efficiently makes an accumulated ice (and drifted snow) formation which is able to sustain its mass longer into the warm season. FIG. 18 depicts a pair of baffles 1800 positioned within a semicircle to disturb wind, thereby causing accumulation of wind blown material. Shapes are built in lines North and South so as to give a timed release of structures as ice melts in the warm season. Structures are sized to provide animals habitat and seeding for earlier season freeze up. In at least some embodiments, greater or fewer number of baffles 1800 are used.

Figure 19:
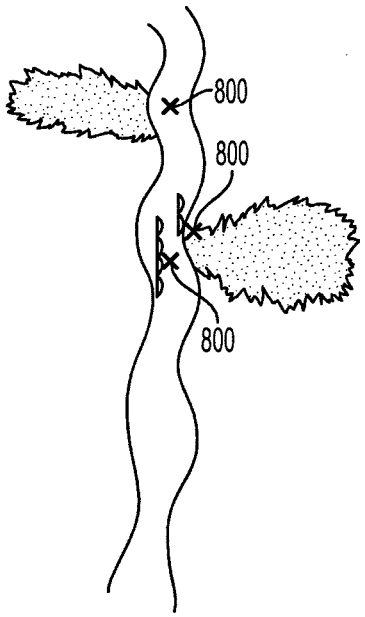
FIG. 19 is a top view of an example of highland impounding according to an embodiment using more than one IBM.

FIG. 19 is a top view of an example of highland impounding using more than one IBM 800. Several IBMs 800 working along a marine body, such as a river, to impound water in the form of ice, snow or water and (in at least some embodiments) using sediment or other insulation. In at least some embodiments, upstream impounding for water resource management and the reservation of fresh water runoff is performed using one or more IBMs 800.

Figure 20:
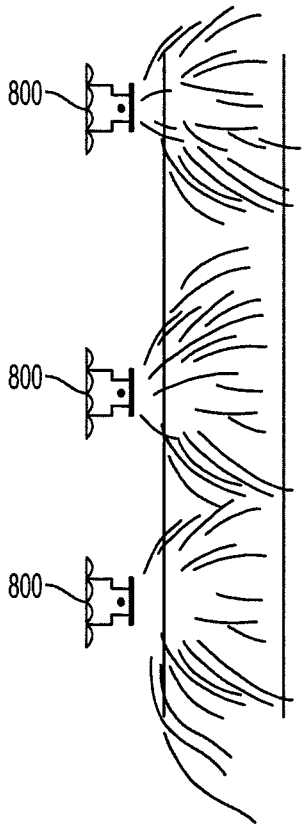
FIG. 20 is a top view of an example of creating ice structures according to one or more embodiments.

FIG. 20 is a top view of an example of creating ice roads and/or landing strips, especially those on or near a marine body. In at least some embodiments, such built ice structures have an earlier open and later closure to the useful operating season when those structures are built and maintained by described autonomous IBM 800.

Figure 21:
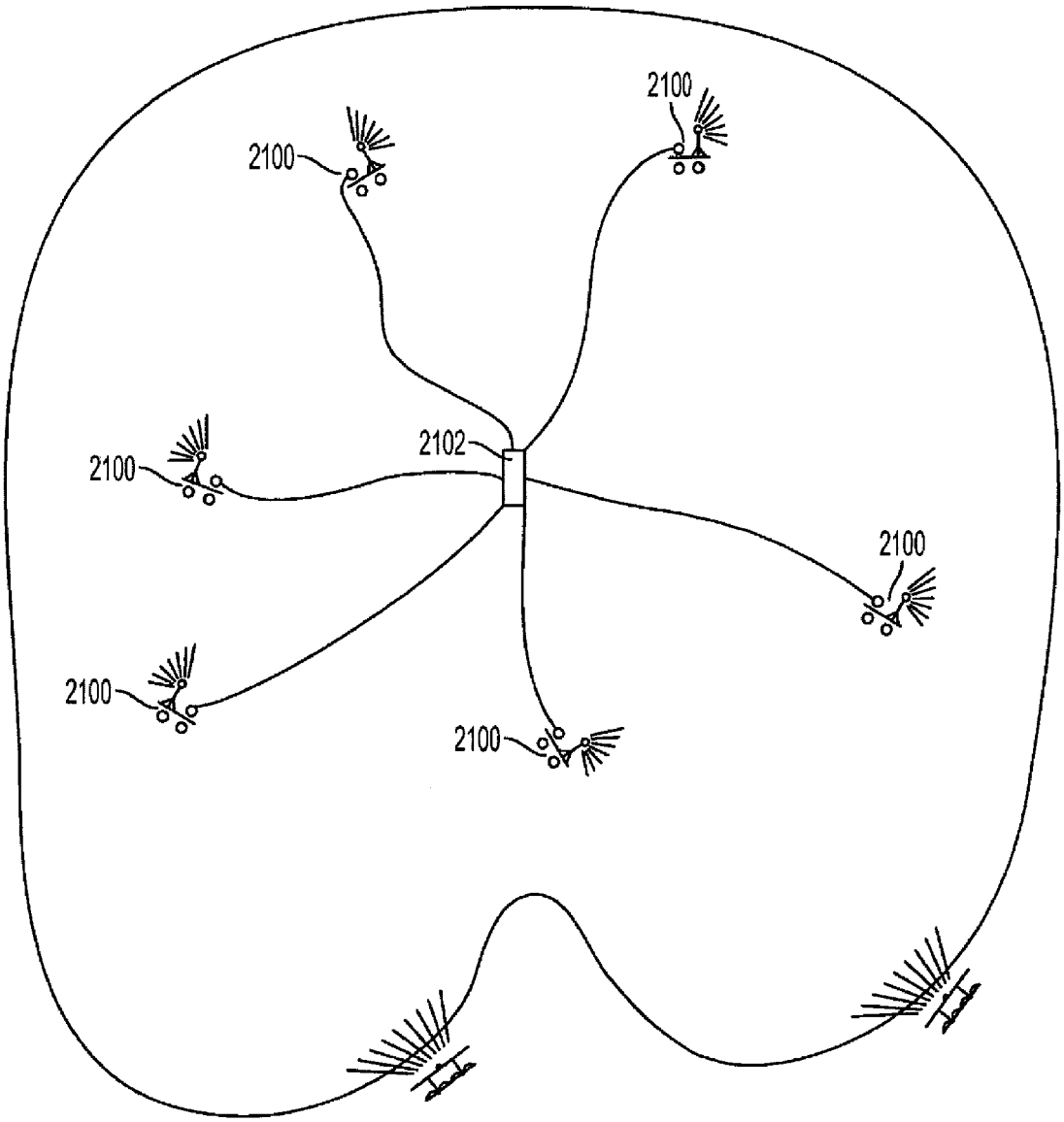
FIG. 21 is a top view of another example embodiment of ice construction using multiple IBMS.

FIG. 21 is a top view of another example embodiment of desired ice construction using several IBMs 2100 (similar to IBM 800). of the depicted arrangement comprises a kind of spray ice and flood freeze platform designed for use by the oil industry and, in at least some embodiments, the creation of a mass of ice large enough to protect coastal communities affected by erosion.

Using less independent ice building machines (for example, wired (or tethered) or wirelessly connected IBMs 2100), large masses are built using a central power and water barge 2102 or similar platform/mother ship, to supply ice building machines by way of a tether for the supply of power and water to the IBMs. The barge 2102 supplies energy for mobility and spray heads and material to be diffused (for example, desalinated water) from a central location.

Figure 22A:
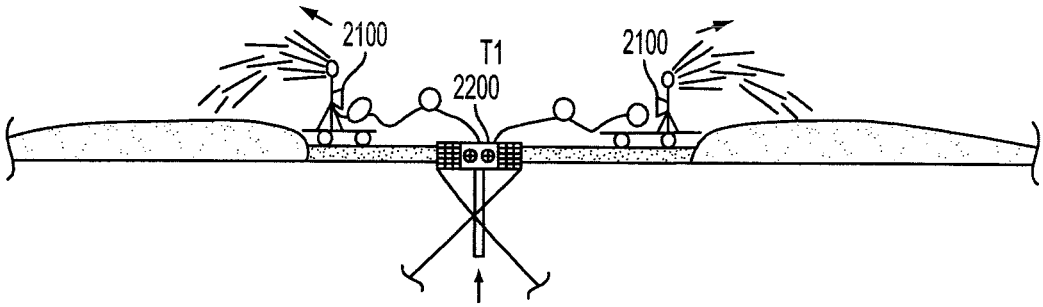
FIG. 22A-B are side views of multiple IBMs at sequential time periods according to an embodiment.
Figure 22B:
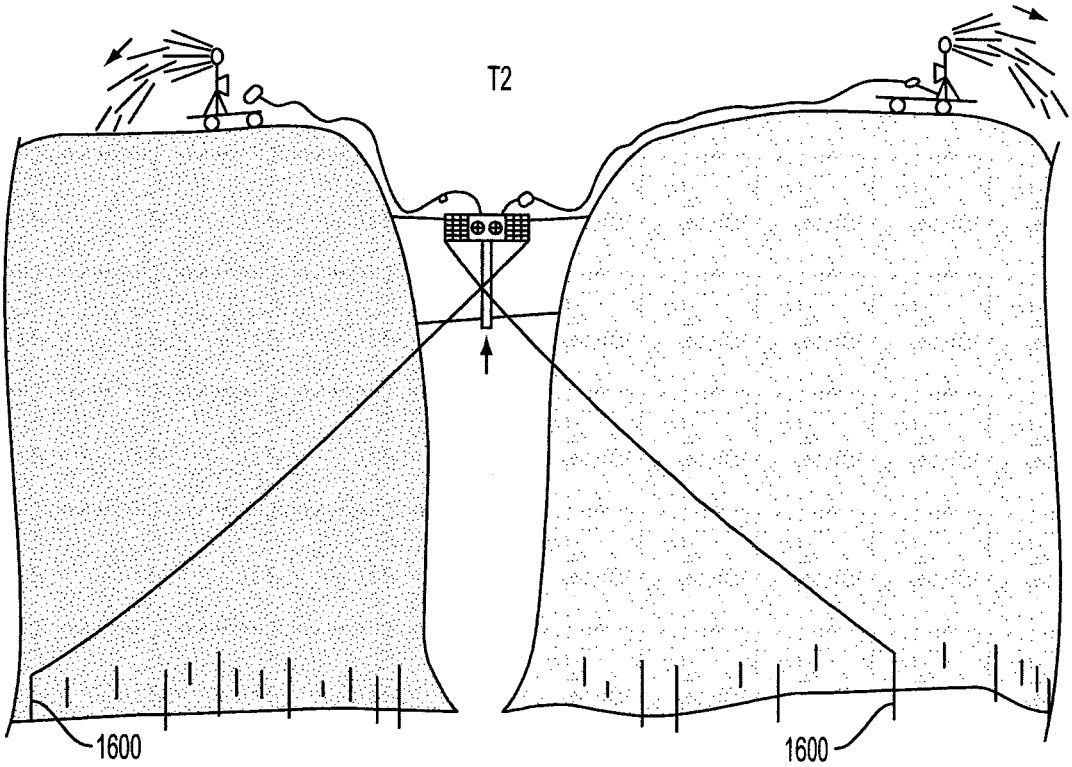

FIGS. 22A and 22B are side views of IBMs 2100 at sequential time periods. The passage of time between T1 (FIG. 22A) and T2 (FIG. 22B) represents the buildup of ice over time. IBMs 2100 are connected to a central barge 2200 anchored/secured in place, multiple machines connected by tether, build ice around a central location. Ice formed according to this scenario is limited in size by the duration of the subfreezing season and the size and number of machines deployed independently or on a tether.

Wind and/or fuel powered IBMs 800 are programmable to build a single large mass of ice in one location. The mass extends to the bottom of a marine body as ice is accumulated upon the surface. The mass is held in place by central barge 2200 anchors, pilings 1600 (FIG. 16) and/or cables secured to the marine floor.

A reel supplying water and power (via tether) connects to barge 2200 at the point of deploying an ice builder 800, 2100 and a second supply reel (tether) connected with the ice builder 800, 2100. The use of two reels to supply each mobile sprayer 800, 2100 allows for greater range and other benefits.

At the center of the ice mass are platforms for supplying fresh water and electricity to tethered ice builders 2100 and fuel and services to untethered ice builders 800. Platforms also serve as a foundation for industry standard oil and gas operations.

Ice builders 800 work in a circle around the central supply/drill location, to build a massive column with a thickness impervious to the movement of ice sheets and tall enough to be anchored to the bottom of a marine body. Sized large enough to withstand the warm season, such ice structures are rebuilt during subfreezing temperatures.

Figure 23:
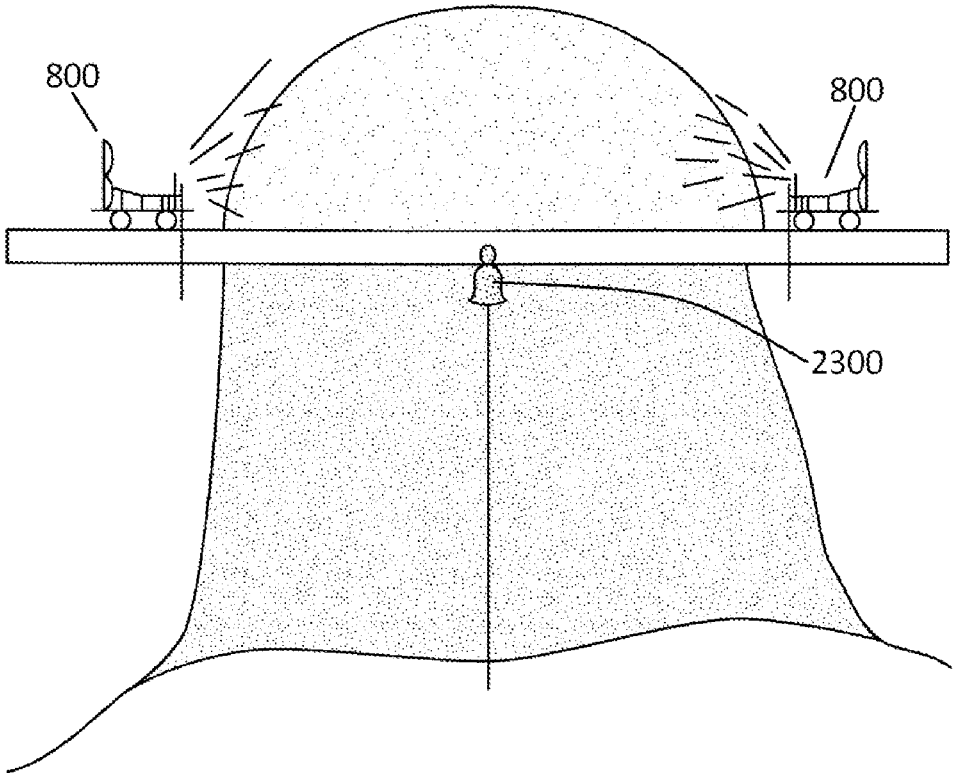
FIG. 23 is a side view of an ice structure constructed by one or more IBMs according to an embodiment.

FIG. 23 is a side view of an ice structure constructed in a location where the sea floor is at or near the water/ice surface, e.g., in sand bars and other formations. Marked by buoy 2300 and using a similar anchorage mechanism as for massif formation. The built ice structure is grounded upon the sea floor, is made to stay in place, as primarily an animal habitat, with sizing to withstand the polar summer, wind and water currents etc., until rebuilding each winter as illustrated and described above.

Buoy-Related Embodiment

Figure 24:
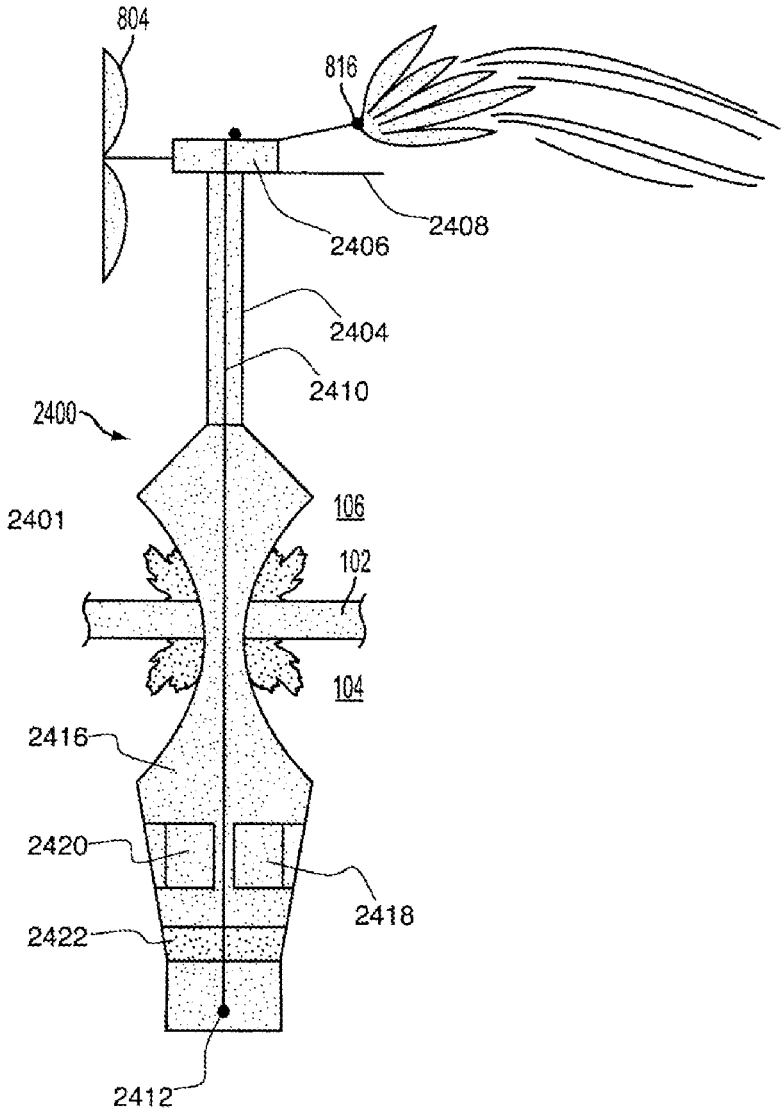
FIG. 24 is a side sectional view of an IBM according to an embodiment.

FIG. 24 is a side sectional view of an anchored IBM 2400 (similar to IBM 800 of FIG. 8) depicted according to an embodiment. The anchored IBM 2400 is positioned anchored within at least a portion of an ice sheet. In at least some embodiments, IBM 2400 floats in a body of water.

Buoy IBM 2400 comprises a buoyant body 2402 having a concave central portion about which ice 2401 may form in addition to ice sheet 102. Buoy IBM 2400 also comprises a mast 2404 connected to an upper end of body 2402 for supporting the wind turbine 804, spray nozzles 816, a navigation light or marker 2406, and an antenna 2408. Navigation light/marker 2406 is used to communicate with a remote computer system and/or other machines 100, 700 and/or to provide an indication of the location of buoy IBM 2400.

Mast 2404 is hollow and comprises a conduit 2410 axially and vertically extending through the mast. Conduit 2410 extends vertically through body 2402 and below the water line and ice 102 into the water 104. A lower end of conduit 2410 is open as a water intake 2412 in order to supply water via a pump to spray nozzles 816. Water intake 2412 is surrounded by a filtering screen to preclude the entry of non-liquid material into conduit 2410 and avoid clogging of spray nozzles 816. A main portion of buoy IBM 2400 comprises a fuel storage area 2416 for storing fuel for an engine 2418. Engine 2418 is positioned in a lower portion of buoy IBM 2400 and operates to generate electricity for powering elements of buoy IBM 2400. Buoy IBM 2400 also comprises a pump 2420 for transporting fluid taken in by water intake 2412 to spray nozzles 816. Also included in buoy IBM 2400 to ensure upright orientation of the machine is ballast 2422.

In at least some embodiments, the anchored IBM 2400 is deployed at the beginning of a polar cold season. In at least some embodiments, the IBM 2400 includes a fuel, such as propane, along with an engine for generating power to operate the IBM by burning the fuel to generate electricity. The engine is used in the absence of or presence of a minimal amount of wind and during a time period when exterior temperatures are low enough to cause freezing. The engine is operated to generate power and/or wind-based power generation is used to spray fluid onto a surface surrounding the anchored IBM 2400. The sprayed fluid, as a result of the temperature and spray parameters, freezes onto the surface and a buildup of the frozen spray forms an ice structure surrounding the IBM 2400.

In at least some embodiments, IBM 2400 differs from IBM 800 in that the body shape of the buoy-style IBM is arranged to withstand the impact of ice flows and to be conducive to the buildup of an ice structure surrounding the buoy-style IBM. In at least some other embodiments, IBM 2400 lacks a locomotion device for propelling or moving the machine. In at least some embodiments, IBM 2400 lacks a drilling system 116 as part of fluid spray system 112. In at least some embodiments, due to the lack of the power drain related to locomotion of the machine, more power is used with respect to pumping and spraying of ice.

In at least some embodiments, buoy-style IBM 2400 is not anchored to a particular location and instead drifts freely in a body of water. In at least some embodiments, buoy-style IBM 2400 drifts floating in mapped ocean and/or sea currents. Such drifting buoy IBMs 2400 in operation perform the same ice building of structures as described above and, in at least some embodiments, build floating ice islands surrounding the IBM. In at least some embodiments, the creation of such ice islands provides sanctuary and/or habitat for wildlife such as polar bears and seals. Further, due to the networked communication and reporting of IBM 2400, such ice islands pose less of a hazard to navigating vessels than natural ice bergs.

Figure 25:
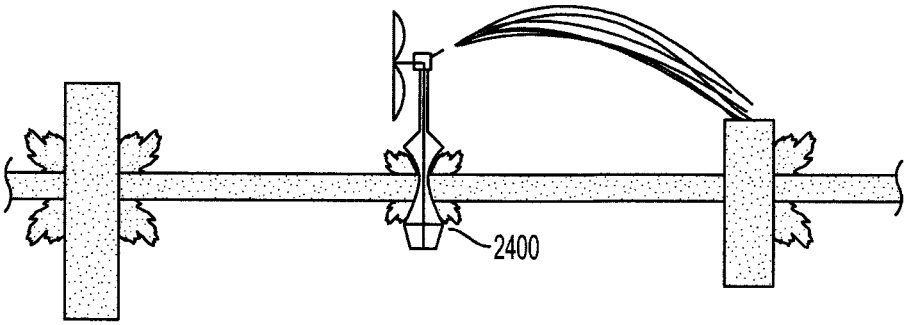
FIG. 25 is a side view of ice buildup from an IBM according to an embodiment.

FIG. 25 is a side view depicting ice buildup at a predetermined distance from the anchored IBM 2400 of FIG. 24.

Figure 26:
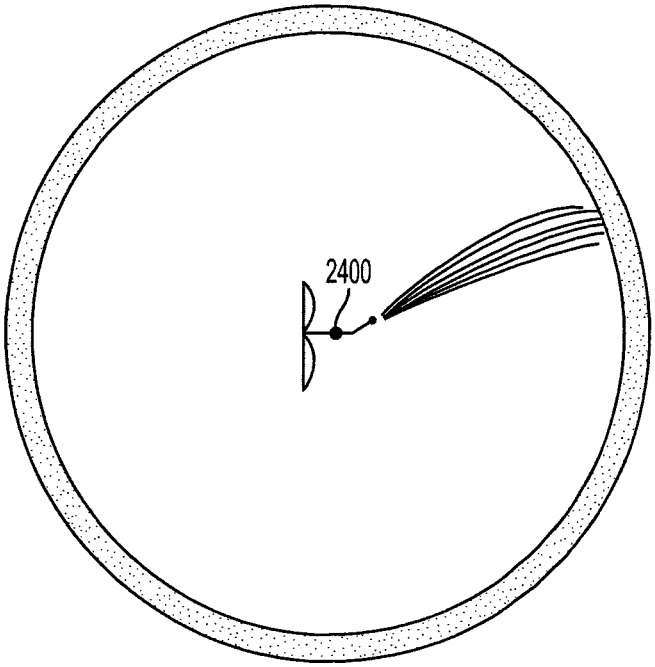
FIG. 26 is a top view of an IBM according to an embodiment.

FIG. 26 is a top view of the anchored IBM 2400 of FIG. 24 with a built up ice structure comprising an outer ring of ice.

Materials And Designs

Not shown are pumps, plumbing, motors, connectors, valves, generators, switches, etc. Prior art and industry standard practices are well understood regarding hydraulic, pneumatic, electric and digital device descriptions and operations expected. Design must be efficient especially when powered by the wind and all designs must be able to withstand the extreme cold.

Converted rotational energy for work can be fluid, electric, and or direct mechanical linkage, dependent on cost and performance desired. Likewise, materials to make machine can be durable or disposable. Likely, a lower cost machine might use wood and plastic, in place of aluminum where cost is an issue.

All machines use heat tape or similar heating device, especially when operating in variable winds, placed to unfreeze/ unstick moving parts, to keep components from freezing and to clear ice accumulated on the machine.

Similar to Unmanned Arial Vehicles, UAVs, an Unmanned Surface Vehicle of the type described above, in some embodiments, builds protective ice walls, artificial ice bergs and seeds the polar oceans for earlier freeze-up in addition to building conventional ice structures and snow formations. The above-described USV travels upon the ice, drills through the surface and pumps water or sprays water to a given location. A more general description is a self guided mobile machine which travels to a location, accesses a fluid and sprays, pumps or diffuses said fluid or another fluid (tether and tank fed) to a desired location. In another embodiment, the ice building machine is not mobile and is instead fixed in a single location.

PROTECTIVE ICE WALL—EXAMPLE #1

Along and upon a frozen river surface, an ice building machine according to an embodiment builds protective ice walls, dividing areas of potential spring flooding and property of value. With a local fuel source, machine size, numbers deployed and atmospheric conditions are the limits determining the size of the protective/flood wall. FIGS. 17A and 17B are side views depicting a first embodiment, i.e., an engine powered remote robotic ice builder (RERIB) corresponding to an embodiment of IBM 100 building a protective ice wall and a second embodiment, i.e., a wind powered RERIB (similar to IBM 100), building erosion protection ice.

Related and alternate uses of the ice building machine include coastal protection, water/ice impounding, sculptor quality ice, off season electric generation, or use as a local water pump for fire, flood, utility purposes.

ARTIFICIAL ICE BERGS—EXAMPLE #2

Working remotely upon a frozen polar sea, an ice building machine according to at least some embodiments, uses wind instead of a local fuel to power similar operations as described above with respect to example #1. Instead of a local ice wall, the ice building machine makes artificial ice bergs. Ice building machines according to such an embodiment are wide ranging and self-navigating, and able to make large ice masses which give habitat to wild life and which last through out a warm season of a particular polar region. Ice remaining in the fall aids the sea in earlier freeze-up.

In the spring, ice building machines park on land and provide local power from onboard mills or migrate closer to the respective pole, on permanent ice, awaiting fall freeze-up.

GEO-ENGINEERING—EXAMPLE #3

The major oil companies have a pattern of being the assignee to invention designs of various ice islands/drilling platforms which are impervious to moving ice sheets. These are shallow, i.e., less than approximately 100 feet in depth, water, massive ice structures described variously in class 405/217 and other classes/subclasses. Ice building machines according to at least some embodiments build ice islands at lower cost. With slight variation of design, e.g., including the use of tethered machines and multiple independent machines, an ice island grounded on the sea floor is possible.

Likewise on a larger scale, the desire is to bypass the insulating effect of surface ice sheets by exposing seawater to the colder 'topside' atmosphere, on the surface. Heat trapped in the ocean is then released into space via the cold polar night. A multitude of ice building machines according to at least some embodiments are able to achieve this effect over a wider area.

Australia needs the ocean currents, winds and or climate at the southern pole to change in order to impact the long existing drought in the region. Slowing down the rate of climate change is of growing interest internationally.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. An ice building machine for spraying a fluid comprising water to form ice, comprising:

a chassis;

a power generating source connected with the chassis;

a locomotion device connected with the chassis and configured to move the machine;

a control module electrically connected with the power generating source, the control module comprising an input/output device, wherein the control module is configured to automatically control movement of the machine along a predetermined path over a solid surface and alter movement from the predetermined path in a predetermined manner to avoid an anomaly in the solid surface detected through the input/output device, wherein the anomaly is at least one of open water, thin ice, deep snow, or a pressure ridge in the solid surface; and a fluid spray system coupled with the chassis and arranged to spray the fluid under control of the control module and powered by the power generating source, the fluid spray system arranged to access the fluid from below a lower surface of the ice building machine;

wherein the control module is further configured to automatically control the fluid spray system based on at least one spray parameter and an ambient temperature.

2. The machine as claimed in claim 1, the fluid spray system further arranged to: access the fluid by drilling through the solid surface below at least a portion of the ice building machine.

3. The machine as claimed in claim 2, the fluid spray system further arranged to: transfer the fluid from below the at least a portion of the ice building machine.

4. The machine as claimed in claim 1, wherein the locomotion device comprises one or more wheels.

5. The machine as claimed in claim 1, wherein the locomotion device is operatively coupled with the control module and arranged to receive commands from the control module and wherein the locomotion device is operatively coupled with the power generating source to receive motive power.

6. The machine as claimed in claim 1, wherein the control module comprises a navigation module.

7. The machine as claimed in claim 1, wherein the fluid spray system comprises:

a drilling system;

a pumping system; and a nozzle set.

8. The machine as claimed in claim 7, wherein the drilling system comprises a pneumatic pump.

9. The machine as claimed in claim 1, the power generating source comprising a storage for storing power generated by the power generating source.

10. The machine as claimed in claim 9, the storage being at least one of a pneumatic storage tank arranged to store compressed air, a hydraulic storage tank arranged to store hydraulic fluid, or a battery arranged to store electricity.

11. The machine as claimed in claim 1, the power generating source comprising at least one of a fluid flow based power generating source or an internal combustion engine based power generating source.

12. The machine as claimed in claim 11, the fluid flow based power generating source comprising a wind based power generating source.

13. A method of building ice structures through the use of an unmanned ice building machine, comprising:

moving the ice building machine to a predetermined location, the moving comprising automatically controlling movement of the machine along a predetermined path over a solid surface and altering movement from the predetermined path in a predetermined manner to avoid an anomaly, the anomaly being at least one of open water, thin ice, deep snow, or a pressure ridge in the solid surface;

accessing a fluid source by the ice building machine; and spraying the accessed fluid toward a predetermined surface to form a desired ice structure, the spraying being automatically controlled based on at least one spray parameter and an ambient temperature.

14. The method as claimed in claim 13, the moving comprising autonomously moving the ice building machine to the predetermined location.

15. The method as claimed in claim 13, the spraying comprising spraying based on fluid flow based power generated by the ice building machine.

16. The method as claimed in claim 13, the predetermined surface being a water surface proximate the ice building machine.

17. The method as claimed in claim 13, the predetermined surface being the surface of a body of water surrounding the ice building machine.

18. An ice building machine for spraying a fluid comprising water to form ice, comprising:

a chassis;

a power generating source connected with the chassis;

a locomotion device connected with the chassis and configured to move the machine;

a control module electrically connected with the power generating source, the control module comprising an input/output device, wherein the control module is configured to automatically control movement of the machine along a predetermined path over a solid surface and alter movement from the predetermined path in a predetermined manner to avoid an anomaly in the solid surface detected through the input/output device, wherein altering movement in the predetermined manner comprises at least one of travelling over ice built in response to detection of the anomaly or maneuvering around open water; and a fluid spray system coupled with the chassis and arranged to spray the fluid under control of the control module and powered by the power generating source, the fluid spray system arranged to access the fluid from below a lower surface of the ice building machine;

wherein the control module is further configured to automatically control the fluid spray system based on at least one spray parameter and an ambient temperature.

19. The machine as claimed in claim 18, wherein maneuvering around open water comprises moving parallel to the anomaly until a crossing is found.

* * * * *